United States Patent [19]

Miller

[11] 4,202,403

[45] May 13, 1980

[54] ROLLOVER CLOSER

[75] Inventor: Charles R. Miller, Bedford, Ohio

[73] Assignee: Combustion Engineering, Inc., Windsor, Conn.

[21] Appl. No.: 898,586

[22] Filed: Apr. 21, 1978

[51] Int. Cl.[2] ..... B22C 17/08

[52] U.S. Cl. ..... 164/409; 164/168; 164/339

[58] Field of Search ..... 164/29, 137, 168, 181, 164/185, 189, 205, 223, 224, 339, 409; 198/434, 422, 345

[56] References Cited

U.S. PATENT DOCUMENTS

| | | | |
|---|---|---|---|
| 2,742,683 | 4/1956 | Knipp et al. | 164/409 |
| 3,068,537 | 12/1962 | Fellows | 164/168 |
| 3,303,536 | 2/1967 | Pegon | 164/137 |
| 3,638,564 | 2/1972 | Prange et al. | 198/434 X |

*Primary Examiner*—Robert D. Baldwin
*Assistant Examiner*—J. Reed Batten, Jr.
*Attorney, Agent, or Firm*—Robert L. Olson

[57] ABSTRACT

A system for automatically assembling flaskless copes and drags, preparing them for metal pouring on an indexing conveyor belt. A cope is centered on the conveyor, lifted, and rotated 180°. Thereafter, a drag is centered beneath the cope, and the cope is lowered onto the drag, to form a complete mold, ready for metal pouring. All of the above is accomplished automatically, with little or no supervision required.

1 Claim, 10 Drawing Figures

ROLLOVER CLOSER

BACKGROUND OF THE INVENTION

The method of forming flaskless molds automatically has been practiced for some time. The economic advantages have long been recognized. Most systems in existence today have some shortcomings, however, with either the quality of the finished mold being poor, these systems being too complicated, or the production rate being too low.

SUMMARY OF THE INVENTION

The flaskless molding line of the present invention can produce high quality finished, assembled molds, at speeds of up to 100 per hour on an indexing conveyor belt. By means of the rollover closer machine of the invention, the copes and drags are accurately aligned and assembled, so they are ready to be poured.

DESCRIPTION OF THE PREFERRED EMBODIMENT

Figure 1:
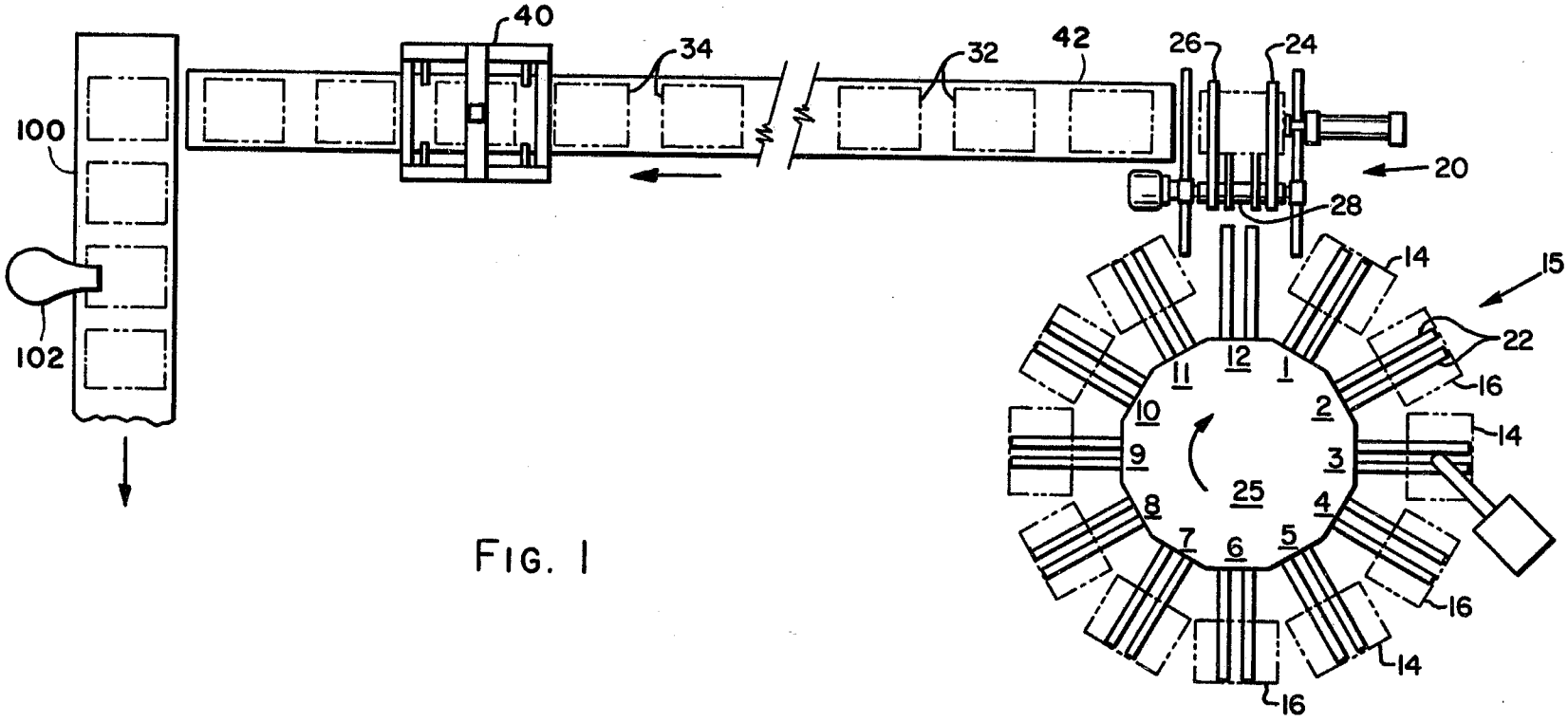
FIG. 1 is a plan view of a mold making assembly incorporating the rollover closer of the invention.

Looking now to FIG. 1, numeral 15 designates an indexing turntable having twelve stations, numbered 1–12 respectively. An indexing motor rotates the table 30°, for example every 18 seconds. At stations 1 and 2, an operator can remove and replace the flasks with ones of differently configured patterns or sizes, if such is desired. The cope and drag flasks are alternated, with every other one being a cope flask 14 with a drag flask 16 located therebetween. All of the flasks have an integral pattern secured in the bottom thereof. At station 3, the flasks are filled with chemically bonded sand, in any of several well-known manners. From stations 4 through 11, the sand is allowed to set up or harden. Thus, with a turntable that indexes every 18 seconds, approximately two and one-half minutes are allowed for the sand to cure. At station 12, the flask, containing either a cope or drag therein, is removed from the turntable by means of the rollover draw machine 20. The flasks, in being indexed about the turntable 15, are carried on a pair of tines 22, which are supported by and extend from the central hub or table 25. The rollover draw machine is described in greater detail in my copending patent application filed on even date herewith, Ser. No. 898,587, now U.S. Pat. No. 4,172,488 issued Oct. 30, 1979 and entitled "Flaskless Molding Line for Chemically Bonded Sand Molds."

The rollover draw machine 20 has a pair of arms 24 and 26 rotatable about axis 28 that picks the mold halves up, and rolls them over, shakes them out of their flasks, and deposits them on the indexing conveyor belt 42 with the parting line or pattern side up. The conveyor belt 42 is indexed to coincide in movement with the turntable; i.e. it moves forward a given distance every 18 seconds. At stations 32 and 34 the mold halves can be washed, inspected, and cores set in the drags.

Figure 2:
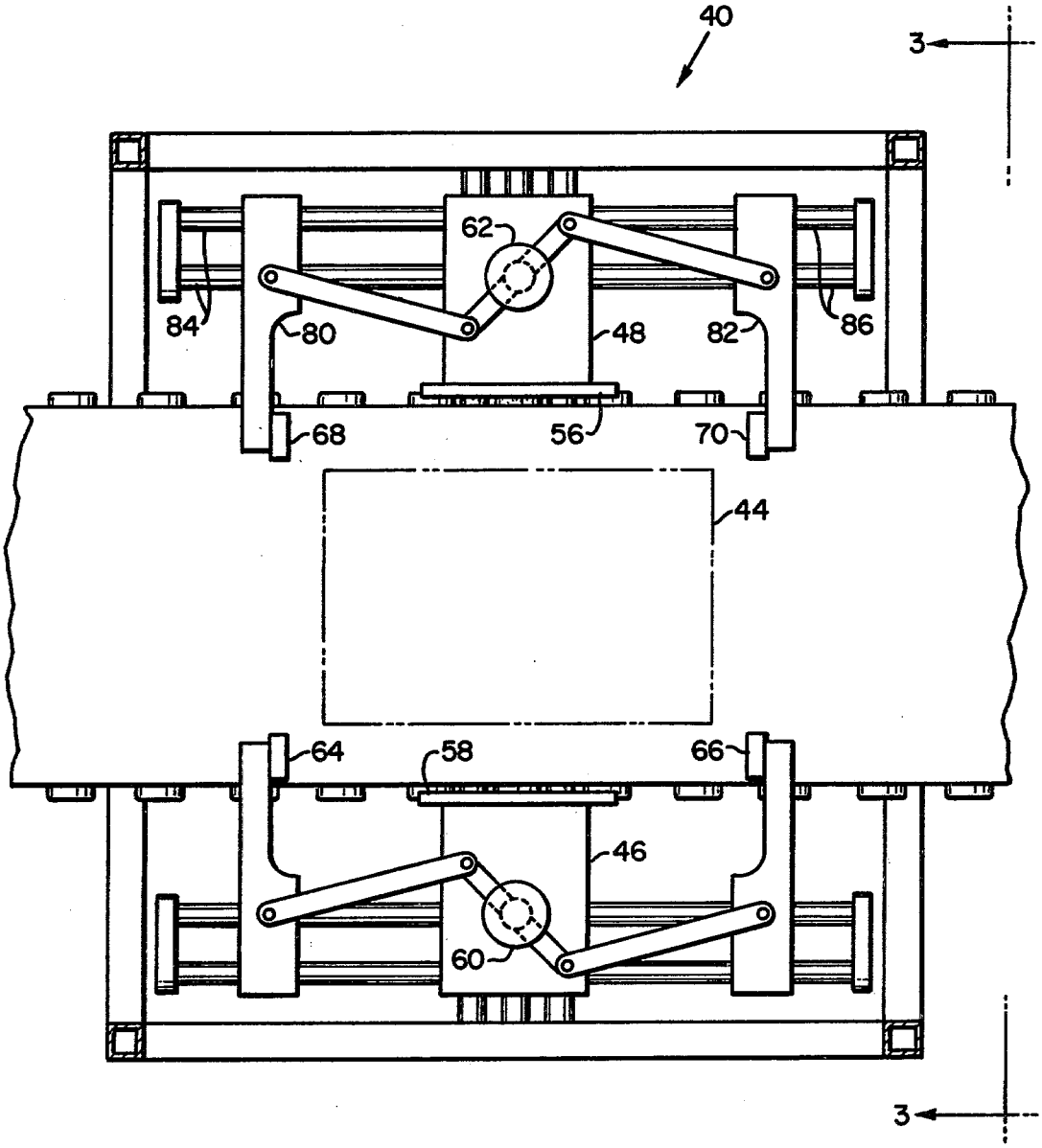
FIG. 2 is a plan view of the rollover closer.
Figure 3:
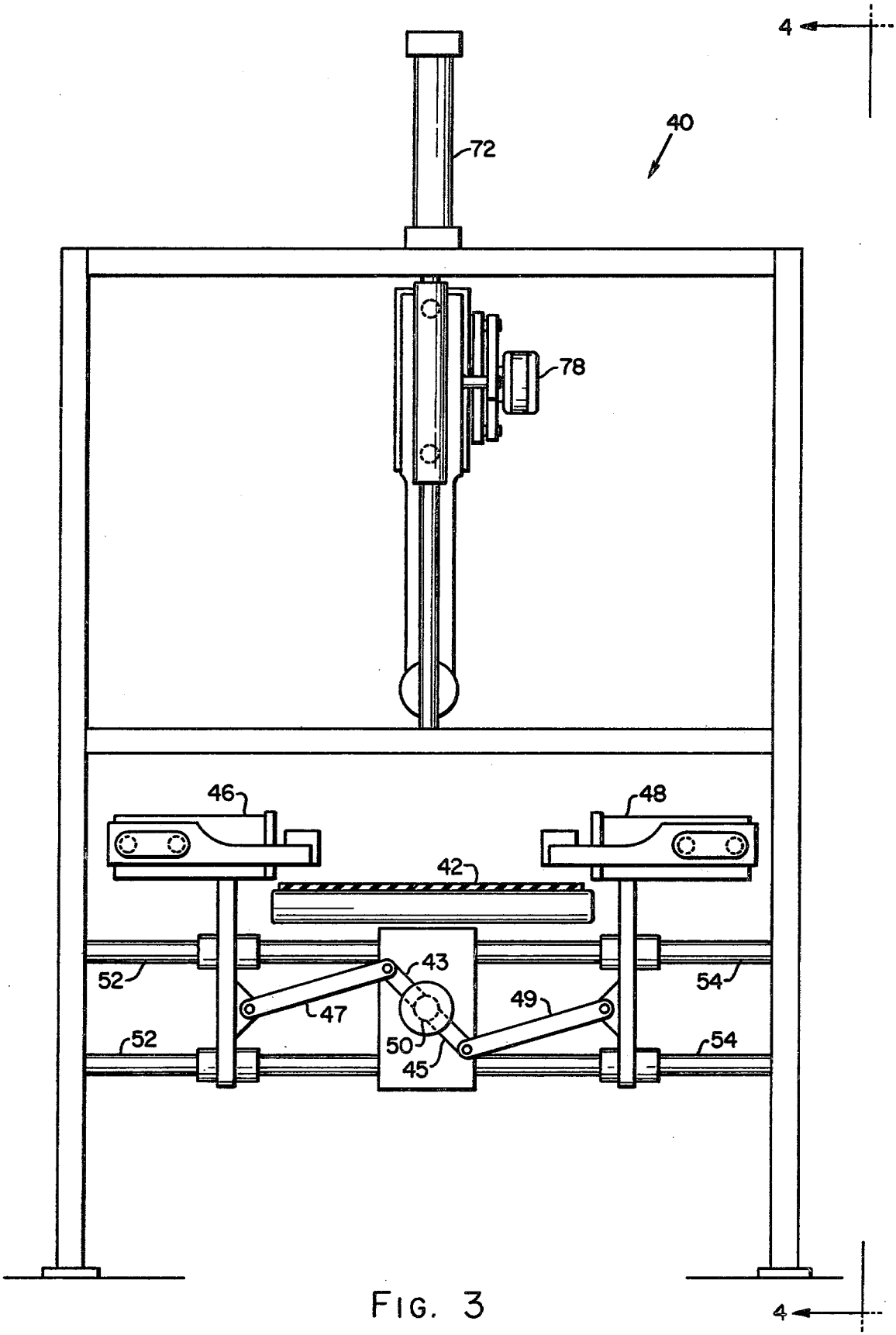
FIG. 3 is a sectional view taken on line 3—3 of FIG. 2.
Figure 4:
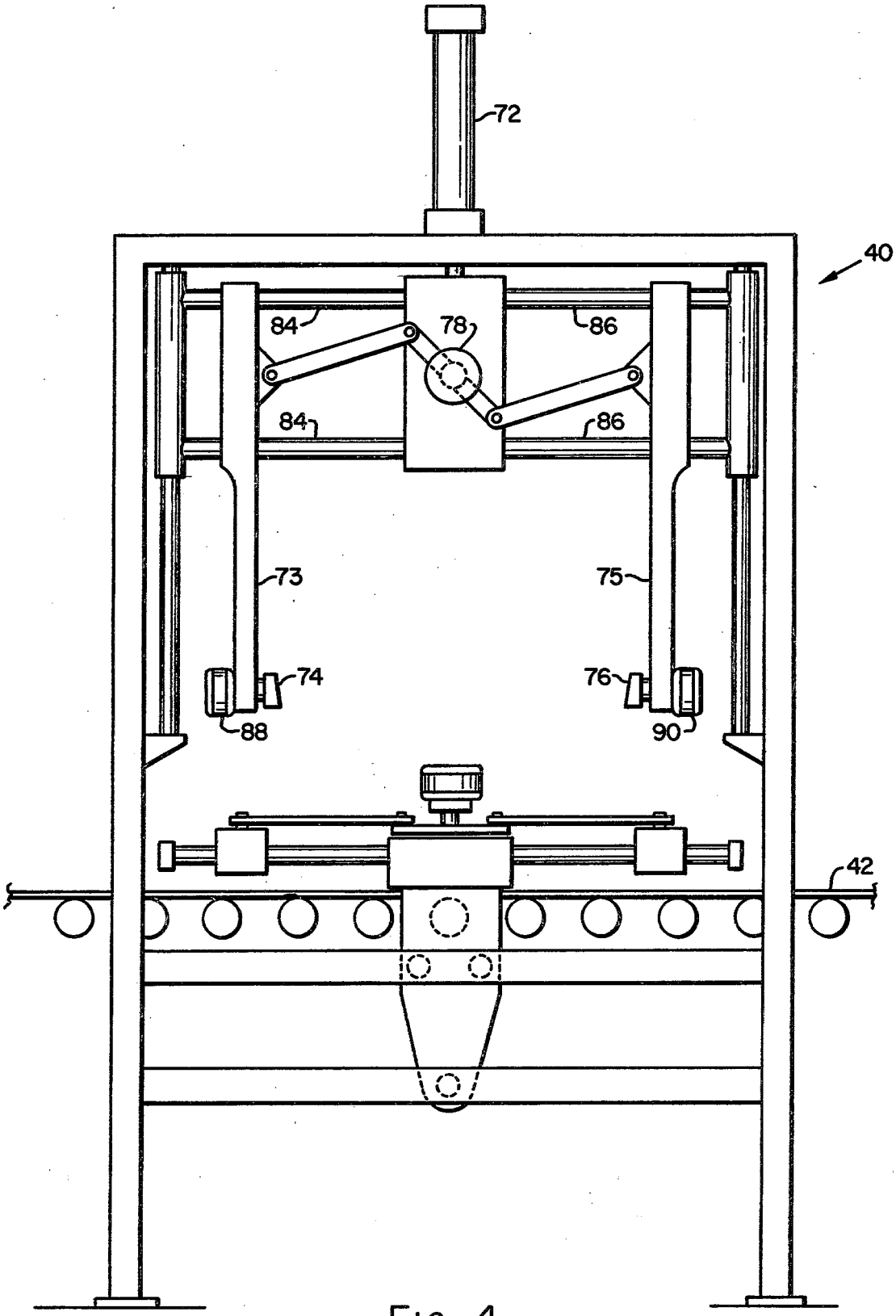
FIG. 4 is a view taken on line 4—4 of FIG. 3.

Looking now to FIGS. 2–4, the rollover closer machine is shown in more detail. Numeral 40 designates the rollover closer machine in its entirety. To start the operation, the conveyor belt 42 will move a cope 44 into the area of the rollover closer. The belt then stops. The blocks 46 and 48 are actuated inwardly towards the cope by a hydraulic rotary motor 50 (FIG. 3). Links 43 and 45 are rigidly attached to the output shaft of motor 50, and links 47 and 49 are pivotally connected to the links 43 and 45. Thus, clockwise movement of motor 50 moves blocks 46 and 48 inwardly, and counter-clockwise movement moves them outwardly. The blocks 46 and 48 slide along rods 52 and 54 respectively, to make the pads 56 and 58 come into contact with the sides of the cope 44. If the cope comes into the rollover closer machine somewhat off-center from side-to-side, this operation will center it.

Looking now to FIG. 2, it can be seen that the blocks 46 and 48 each carry a hyraulic rotary motor 60 and 62. These rotary motors are actuated at the end of the side-to-side centering operation. Each motor actuates a pair of longitudinal centering pads 64, 66, and 68, 70 respectively. Pads 68 and 70 are carried on arms 80, 82, respectively. Pads 64 and 66 are carried by similar arms. Thus, the cope is centered or positioned longitudinally by these members. Rotary motor 50 is again actuated and the cope is clamped and held in centered position. At this point in time, a piston-cylinder 72 (FIGS. 3 & 4) moves downwardly, bringing gripping pads 74 and 76 into operative position. Rotary motor 78 then moves the gripping pads 74 and 76 inwardly, with arms 73 and 75 sliding on rods 84 and 86, until the pads 74 and 76 contact and tightly grip the cope 44. All of the centering pads are then operated in the reverse direction, away from the cope.

The piston-cylinder 72 then is reversed, lifting the cope 44 up off the conveyor belt. At this point in time, motors 88 and 90 are actuated, rotating the cope 44 180°, so as to bring the parting line or pattern side facing down. All of the above takes place in one indexing period of 18 seconds. The conveyor belt is then again actuated or indexed, bringing a drag 92 (FIG. 8) into the rollover closer station. The rotary motor 50 is again actuated, centering the drag from side-to-side. Once it is centered, the motor backs off slightly, so that the drag is not tightly held, which is true also of the cop during its handling. Rotary motors 60 and 62 are then actuated, centering the drag longitudinally. Rotary motor 50 is again actuated and the drag is clamped and held in centered position. Piston-cylinder 72 then lowers the cope 44, which is positioned directly above the drag, until it seats on the drag. Rotary motor 78 is actuated to back off pads 74 and 76 to release the cope mold. The piston-cylinder 72 then withdraws upwardly, and the gripping pads 56, 58, 64, 66, 68 and 70 are retracted. This ends another indexing period, and the machine is ready to start over, receiving another cope. A completed mold is now about to leave the rollover closer station 40, ready in every respect to be poured at a later station.

Figure 5:
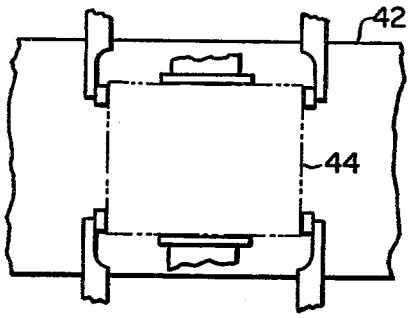
FIGS. 5–10 are step-by-step schematics of the operation of the rollover closer machine.
Figure 6:
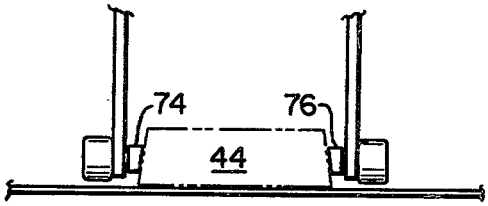
Figure 7:
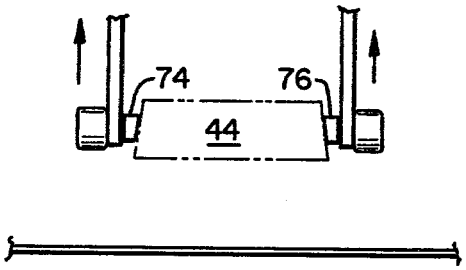
Figure 8:
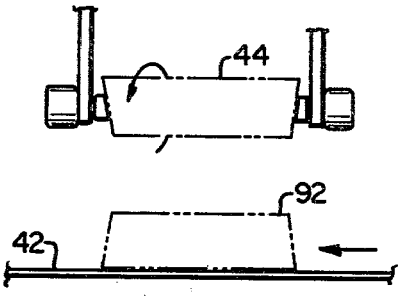

FIGS. 5–10 show the various successive stages accomplished at the rollover closer station. First the cope 44 is centered from side-toside, and longitudinally (FIG. 5). Since the mold halves are centered about a center point, and not from a corner on the mold half, the unit is capable of handling molds of different sized without making any changes in the controls. The unit next brings gripping pads 74 and 76 into position for gripping the cope 44 (FIG. 6), lifting it (FIG. 7) and rotating it 180°, while the belt advances, bringing a drag 92 into place beneath the cope (FIG. 8).

Figure 9:
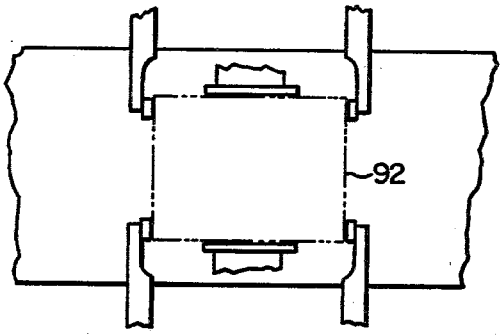
Figure 10:
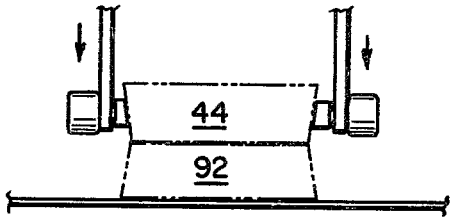

The drag 92 is then centered, both side-to-side and longitudinally (FIG. 9). The cope 44 is then lowered onto the drage 92 (FIG. 10) to finish the operation, forming a completed mold for pouring at a later station. The assembled mold then is transferred onto the conveyor 100 and molten metal is poured from pouring ladle 102 to form the casting.

What is claimed is:

1. Mold making apparatus including a conveyor belt, placement means for placing a flaskless cope on the belt with the pattern-side up, control means for periodically moving the belt longitudinally a given distance, said placement means adapted for thereafter placing a flaskless drag on the belt, with the pattern-side up, behind the cope, a rollover closer positioned at a location along the conveyor belt, said rollover closer including centering means to center a cope from side-to-side, and longitudinally, about an indexing point on the belt, lifting means to thereafter lift the cope and rotate it 180°, holding it centered above the indexing point, the control means adapted for thereafter moving the belt to bring a drag into the rollover closer, said centering means adapted for then centering the drag from side-to-side and longitudinally about said indexing point on the belt, so that the drag is directly beneath the cope, said lifting means adapted for then lowering the cope onto the drag, thereby forming a finished mold ready for pouring, the centering means including moveable closer arms that contact the cope or drag on all four sides, to move the cope or drag so as to be centered with respect to said indexing point, motor means for moving the arms, the arms each being made up of a pair of pivotally connceted links, with one end of one of the links being connected to the motor means, and gripping pads for engagement with either the cope or drag connected to one end of the other link, so that actuation of the motor means moves the gripping pads into and out of engagement with either the cope or drag.

* * * * *